US007721800B2

(12) United States Patent
Symons et al.

(10) Patent No.: US 7,721,800 B2
(45) Date of Patent: May 25, 2010

(54) FLOW CONTROL MECHANISM FOR A DOWNHOLE TOOL

(75) Inventors: Jonathan Symons, Aberdeen (GB); Gordon Heselton, Kincardineshire (GB)

(73) Assignee: Driftco Limited, Aberdeen (GB)

( * ) Notice: Subject to any disclaimer, the term of this patent is extended or adjusted under 35 U.S.C. 154(b) by 435 days.

(21) Appl. No.: 10/492,987

(22) PCT Filed: Oct. 17, 2002

(86) PCT No.: PCT/GB02/04688

§ 371 (c)(1),
(2), (4) Date: Jan. 10, 2005

(87) PCT Pub. No.: WO03/033857

PCT Pub. Date: Apr. 24, 2003

(65) Prior Publication Data

US 2005/0115718 A1 Jun. 2, 2005

(30) Foreign Application Priority Data

Oct. 17, 2001 (GB) ..... 0124914.3

(51) Int. Cl.
*E21B 17/10* (2006.01)
*E21B 17/12* (2006.01)
*E21B 23/04* (2006.01)

(52) U.S. Cl. ..... 166/212; 166/241.4; 175/325.1

(58) Field of Classification Search ..... 166/381, 166/212, 241.4; 175/325.1; 367/83
See application file for complete search history.

(56) References Cited

U.S. PATENT DOCUMENTS 2,602,510 A * 7/1952 Baker ..... 137/68.17
2,839,142 A 6/1958 Huber
3,066,739 A 12/1962 Saurenman et al.
3,568,783 A * 3/1971 Chenoweth et al. ..... 175/92
4,608,861 A * 9/1986 Wachtler et al. ..... 73/152.48
4,776,394 A * 10/1988 Lynde et al. ..... 166/55.8
4,817,739 A * 4/1989 Jeter ..... 175/38
5,375,658 A 12/1994 Schultz et al.
5,411,096 A * 5/1995 Akkerman ..... 166/321
6,237,701 B1 * 5/2001 Kolle et al. ..... 175/1
6,615,933 B1 * 9/2003 Eddison ..... 175/284
2002/0159333 A1 * 10/2002 Hahn et al. ..... 367/83

* cited by examiner

*Primary Examiner*—David J Bagnell
*Assistant Examiner*—Brad Harcourt
(74) *Attorney, Agent, or Firm*—Tarolli, Sundheim, Covell & Tummino LLP

(57) ABSTRACT

There is disclosed a flow control mechanism for a downhole tool and a downhole tool incorporating the flow control mechanism. In one embodiment, a flow control mechanism (202) is disclosed for controlling a centralizer (200). The flow control mechanism (202) comprises a body (212) defining a fluid chamber (234); an inlet flow path (292) for fluid flow into the chamber (234); at least one tool flow path (294) for fluid flow between the chamber (234) and at least part of the downhole tool (200); an exhaust flow path (297) for fluid flow from the chamber (234) to a fluid exhaust (240); and control means including a control member (218) mounted for movement within the chamber (234) for controlling flow into and out of the chamber (234) along the inlet flow path (292), the at least one tool flow path (294), and the exhaust flow path (297). The mechanism (202) controls flow to a piston (214) of the centralizer (200) for centralizing the centralizer (200) within, for example, a tubular (211) in the bore hole.

13 Claims, 12 Drawing Sheets

FLOW CONTROL MECHANISM FOR A DOWNHOLE TOOL

FIELD OF INVENTION

The present invention relates to a flow control mechanism for a downhole tool. The present invention also relates to a downhole tool assembly including a downhole tool and a flow control mechanism.

BACKGROUND TO INVENTION

To comply with safety regulations and to monitor the inclination of well boreholes, among other reasons, the hole may be surveyed periodically during drilling. It is important, for example, that the location of the drill bit relative to the mouth of the hole is known so that a relief well can be drilled in the event of a blow-out.

It is presently known to measure the inclination of a drilled hole using one of four types of devices. The first type of device is a drift indicator, the second is a magnetic single shot device, the third is a mechanical measuring-while-drilling device (MMWD), and the fourth is a directional measuring-while-drilling device (DMWD).

The first two types of device (the drift indicator and the magnetic single shot device) have been used for more than 50 years. They require a person drilling a well to lower the device into the hole, wait for the device to perform a reading, raise the device from the hole, and then check the measurement taken by the device. Frequently, a second measurement is required to confirm the accuracy of the first measurement. These devices are very expensive to use because the drilling procedure is halted while the device is being used to survey the hole.

The third type of device (the MMWD) has been used for more than 40 years. It is located above the drill bit in a purpose-built collar. This device uses a swinging mechanical pendulum to measure the inclination of the device with reference to the vertical plane. This inclination reading is linked to a mechanically activated plunger which, when activated, produces a pulse which is transferred to the surface. Each pulse represents 0.5 degrees of inclination. This provides a measurement of the verticality (the downhole inclination) of the hole.

The fourth type of device (the DMWD) is similar to the MMWD but conveys information about the inclination of the hole by means of binary code rather than by mechanically activated pressure pulses. At the drilling console, the code is received, decoded and the results are displayed to the drill operators. The DMWD has a number of disadvantages associated with it. For example, it usually needs at least one trained engineer to operate it correctly and it is more expensive than the other devices.

Presently, the most commonly used device is the MMWD device. It is relatively inexpensive to run and does not require an additional trained engineer to operate it. However, these devices are not very accurate or reliable. They are also very expensive to make because they are housed in collars which can cost more than the combined cost of the component parts inside them. A further disadvantage of these devices is that they are sometimes lost downhole, that is, they have to be abandoned, for example, in situations where the bottom hole assembly becomes stuck.

In the oil and gas exploration and production industry, a wide range of downhole tools are used for performing specific functions in the downhole environment. Many of these tools are fluid pressure activated and include relatively complex flow control mechanisms for controlling activation of the tool. Frequently these tools require a positive fluid flow for activation, for example, flow past the tool when located in a borehole.

Other tools, such as centralisers which are used for centralising a secondary tool in tubing in a well borehole, are mechanical and may include, for example, fins such as rubber fins or sprung arms. Where rubber fins are used, the fins are dimensioned to be a close fit within a tubular in which the centraliser is located whilst sprung arms are compressed inwardly on location of the centraliser within the tubular. In both cases, this acts to centralise a body of the centraliser and thus a tool coupled to the centraliser, such as a drill bit, within the tubular. However, fixed dimension centralisers such as these create potential problems when subsequently removed from the borehole, as a tool such as a packer, valve or jar may have been located in the borehole above the centraliser, these tools restricting the diameter of the borehole and making it difficult to withdraw the centraliser.

It is amongst the objects of embodiments of the present invention to obviate or mitigate at least one of the foregoing disadvantages.

SUMMARY OF INVENTION

According to a first aspect of the present invention there is provided a flow control mechanism for a downhole tool, the mechanism comprising:

a body defining a fluid chamber;

an inlet flow path for fluid flow into the chamber;

at least one tool flow path for fluid flow between the chamber and at least part of the downhole tool;

an exhaust flow path for fluid flow from the chamber to a fluid exhaust; and control means including a control member mounted for movement within the chamber for controlling flow into and out of the chamber along the inlet flow path, the at least one tool flow path, and the exhaust flow path.

The invention therefore provides a control mechanism for controlling fluid flow within a downhole tool by movement of a control member of the mechanism. Thus the mechanism may be used to control exposure of the downhole tool to fluid pressure. The mechanism may be for controlling flow between the chamber and a fluid activated member of the downhole tool, such as a piston, valve or sliding sleeve.

The control mechanism may be activatable in response to applied fluid pressure, and may be activatable in response to a static fluid pressure, for example, the hydrostatic pressure of a fluid in which the control mechanism is located, such as the well pressure of fluid in a borehole of an oil or gas well. Accordingly, the mechanism may be adapted to be activated by hydrostatic well pressure and does not require fluid flow for activation, in contrast to prior assemblies. The mechanism may also be activatable in response to fluid flow, and may therefore be activatable in response to applied pressure of a flowing fluid. The mechanism may therefore function in a fluid flow environment, for example, where there is fluid flow past the downhole tool, or by supplying hydraulic fluid to the mechanism through control lines or the like.

The mechanism may be adapted to be provided as an integral part of a downhole tool, or as a separate mechanism adapted to be coupled to a downhole tool. The mechanism may comprise a control mechanism for a plurality of downhole tools and the control member may be movable for controlling flow between the chamber and parts of a plurality of downhole tools. The body may comprise a body of a downhole tool, or may comprise a separate body adapted to be coupled to a downhole tool.

The control member may be movable in a direction along a length of the body and may define an activating member. The control member may be movable for opening flow between the inlet flow path, the chamber and the part of the downhole tool, for supplying fluid to the downhole tool. The control member may also be movable for opening fluid flow between the downhole tool, the chamber and the exhaust flow path.

The mechanism may comprise an inlet flow port for flow into the chamber along the inlet flow path, a tool flow port for flow between the chamber and the downhole tool along the tool flow path and an exhaust flow port for flow between the chamber and the exhaust along the exhaust flow path. The mechanism may include a plurality of tool flow ports and associated tool flow paths for flow between the chamber and separate parts of the downhole tool, or between the chamber and parts of a plurality of downhole tools.

The control means may further comprise a plurality of seal elements which, together with the control member, are adapted to control flow into the chamber along the inlet flow path, flow between the chamber and the downhole tool, and flow out of the chamber along the exhaust flow path. The seal elements may be provided in the chamber and may be adapted to seal with a surface of the control member. The control member may be movable out of sealing abutment with the seals for opening fluid flow.

The control member may be movable between a position allowing fluid flow between the inlet flow path and the chamber and between the chamber and the downhole tool, and a further position allowing fluid flow between the downhole tool, the chamber and the exhaust. Thus simple, relatively small movements of the control member may control flow of fluid through the mechanism. The tool flow path may define a flow path for flow between the chamber and the downhole tool and vice-versa. This allows flow both to and from the downhole tool along a single tool flow path. The control member may be locatable in a position where flow between the inlet flow path and the chamber, the chamber and the downhole tool and the chamber and the exhaust, respectively, is prevented or closed, which may comprise a first, running-in position of the control member. This may allow the downhole tool to be run-in to a well without inadvertently activating the mechanism. The control member may be movable to second and third positions where flow is allowed, as described above.

In the first position of the control member, the member may be in sealing engagement with first and second seal elements for closing flow. In the second position, the control member may be out of sealing engagement with a first seal, for allowing flow into the chamber along the inlet flow path and flow between the chamber and the downhole tool; and in the third position, the control member may be out of sealing engagement with a second seal for allowing flow between the downhole tool and the chamber and between the chamber and the exhaust. Flow into the chamber along the inlet flow path may be adapted to be closed before or during movement of the control member to the third position. This allows the chamber to exhaust without further flow into the chamber along the inlet flow path.

The mechanism may further comprise an inlet flow path entrance port for supply of fluid into the inlet flow path. The entrance port may be adapted to be closed before or during movement of the control member to the third position. The mechanism may include a movable plug such as a sleeve or collar movable for closing the entrance port.

The mechanism may further comprise a filter for filtering fluid entering the inlet flow path. This allows the mechanism to be activated using well fluids or other fluids typically found in a well borehole. The movable plug may define the filter, and may define a passage between an inner surface of the plug and the body for flow of fluid into the inlet flow path, the passage dimensioned to prevent solids entering the passage.

In an alternative embodiment, the mechanism may comprise at least two tool flow paths, each tool flow path for fluid flow between the chamber and a respective separate part of the downhole tool, or separate downhole tools. Each flow path may be adapted for flow from the chamber to separate parts of the downhole tool, or from the chamber to respective parts of separate downhole tools, as well as for flow from separate parts of the downhole tool to the chamber, or respective parts of separate downhole tools and the chamber. Thus fluid may be supplied to and exhausted from the downhole tool.

The control member may be movable between a first position allowing flow into the chamber along a first tool flow path and from the chamber to the downhole tool; and a second position allowing flow into the chamber and from the chamber to the downhole tool along a second tool flow path. In the first position, the control member may also allow flow from the downhole tool to the chamber along the second tool flow path. This may facilitate movement of a fluid activated member such as a piston of the downhole tool coupled in a closed loop to the chamber, for example, by fluid flow to one end of the fluid activated member and fluid exhaust from the other end of the fluid activated member. In the second position, the control member may also allow flow from the downhole tool to the chamber along the first tool flow path.

In the first position of the control member, the member may be in sealing engagement with selected seal elements for allowing flow between the chamber and the downhole tool along tool flow paths. In the second position of the control member, the member may be in sealing engagement with selected other seal elements for allowing flow between the chamber and the downhole tool along tool flow paths.

The chamber may be subdivided into a number of secondary chambers which are adapted to be selectively fluidly isolated by the control member. The seal elements, together with the control member, may define the secondary chambers. The control member may include reduced dimension portions which are adapted to straddle a seal element to allow fluid flow. The control member may comprise a needle valve which may be generally rod shaped.

The mechanism may be adapted to be activated mechanically by application of a force to the control member for moving the control member within the chamber. The control mechanism may be adapted to be activated mechanically. For example, the assembly may include a release mechanism coupled to the control member, in a restraint position the release mechanism restraining the control member against movement and in a release position, the control member being movable within the chamber. The release mechanism may be moved between the restraint and release positions by a wireline coupled to the assembly. Alternatively, the release mechanism may be movable by applied fluid pressure, for example, by application of a pressure above a predetermined threshold, or by flow sequencing, for example, by application of fluid pressures in a determined sequence. In further alternatives, the release mechanism may be movable remotely and independently using electronic programming, for example, by electronic wireline coupled to the assembly, or by a combination of any of the foregoing. It will be understood that following activation in this fashion, the control mechanism may be subsequently activated by applied fluid pressure as described above.

The exhaust may comprise an exhaust chamber isolated from the hydrostatic pressure of fluid outside the mechanism. This allows flow to the exhaust chamber from the fluid chamber when required. The exhaust chamber may initially be at surface atmospheric pressure.

According to a second aspect of the present inventions there is provided a downhole tool assembly comprising:

a downhole tool including a fluid activated member; and a flow control mechanism for controlling operation of the fluid activated member, the flow control mechanism comprising: a body defining a fluid chamber; an inlet flow path for fluid flow into the chamber; at least one tool flow path for fluid flow between the chamber and the fluid activated member; an exhaust flow path for fluid flow from the chamber to a fluid exhaust; and control means including a control member mounted for movement within the chamber for controlling flow into and out of the chamber along the inlet flow path, the at least one tool flow path, and the exhaust flow path.

Further features of the flow control mechanism are defined above.

The downhole tool may comprise a plurality of fluid activated members. The fluid activated members may be spaced along a length of the downhole tool, and may be rotationally spaced around the tool. The fluid activated member may be mounted in the body for movement substantially radially with respect to the body.

The downhole tool may comprise a centraliser and the fluid activated member may comprise a piston of the centraliser. Preferably, the centraliser comprises a plurality of pistons which are adapted to centralise the tool within a borehole of an oil or gas well, such as within a tubular such as casing, liner, production tubing or any other tubular. The centraliser may be adapted to centralise a downhole tool within a borehole. Thus the centraliser may be adapted to be coupled to a downhole tool for centralising the downhole tool and the tool may therefore be hydraulically self-centering within a borehole.

Most preferably, the centraliser comprises at least three pistons spaced around a circumference of the centraliser, the pistons being activatable to move outwardly and engage the borehole wall. The piston may be retractable from a radially extended position, allowing the tool assembly to pass through a bore restriction. The piston may be retractable when the control member is in the second position, allowing flow to the exhaust. The pistons may be equally rotationally spaced and where there are three pistons, may be spaced at 120° intervals for centralising the tool when the pistons are moved outwardly. The pistons may act as clamps for clamping a wall of a borehole.

The piston may be mounted in a cylinder coupled to the chamber, the cylinder initially containing a gas at a pressure less than the pressure of fluid supplied to the chamber. The piston may also define a first inner piston area greater than a second, outer piston area, the second piston area being open to well pressure. In this fashion, the piston experiences a force when fluid is supplied from the chamber to the piston cylinder, to move the piston radially outwardly. The piston may extend through a sealed opening in the cylinder and may include an abutment surface which may comprise a protective cover coupled to the piston, for exerting a force on a borehole to centralise the tool within the borehole.

Alternatively, the downhole tool may comprise a downhole tool for generating a fluid pressure pulse, such as a borehole inclination measuring (drift) tool, the tool including a fluid activated member in the form of a piston, the piston coupled to or defining flow restriction means mounted for movement between a first position and a second position where fluid flow is restricted compared to the first position. The piston may be movable in a direction along a length of the tool. The flow restriction means may include the fluid activated member such that movement of the flow restriction means depends upon movement of the fluid activated member, which movement is controlled by the control mechanism.

Further features of the downhole tool for generating a fluid pressure pulse will be defined below.

In alternative embodiments, other downhole tools may be provided incorporating the control mechanism or the control mechanism may be provided as part of a tool used to control other downhole tools; for example a downhole packer; a downhole valve such as an open/shut valve; a sliding sleeve; a downhole shutting tool (for shutting off a well); or a tool for providing temporary positioning of tools, such as cutting or patching tools, in tubing; or as a trigger for other devices such as sampling tools, perforating tools or any other downhole tool requiring positioning and/or activating.

The fluid activated member may comprise a piston coupled to a sliding sleeve, a valve element such as a ball valve or flapper valve or to any other fluid activated member of a downhole tool.

According to a third aspect of the present invention, there is provided a centraliser comprising a flow control mechanism and a fluid activated member movable outwardly for centralising the centraliser in a borehole, the flow control mechanism comprising:

a body defining a fluid chamber;

an inlet flow path for fluid flow into the chamber;

at least one tool flow path for fluid flow between the chamber and the fluid activated member;

an exhaust flow path for fluid flow from the chamber to a fluid exhaust; and control means including a control member mounted for movement within the chamber for controlling flow into and out of the chamber along the inlet flow path, the at least one tool flow path, and the exhaust flow path.

The fluid activated member may be movable radially outwardly for centralising the centraliser in the borehole.

It will be understood that the term centralising within a borehole is intended to include centralising within a tubular within a borehole, for example, casing, liner or production tubing, as well as in an open (unlined) borehole. Further features of the centraliser are defined above.

According to a fourth aspect of the present invention, there is provided a downhole tool for generating a fluid pressure pulse, the downhole tool comprising a flow control mechanism and a flow restriction means, the flow restriction means including a fluid activated member movable between a first position and a second position where fluid flow is restricted compared to the first position, the flow control mechanism comprising:

a body defining a fluid chamber;

an inlet flow path for fluid flow into the chamber;

at least one tool flow path for fluid flow between the chamber and the fluid activated member;

an exhaust flow path for fluid flow from the chamber to a fluid exhaust; and control means including a control member mounted for movement within the chamber for controlling flow into and out of the chamber along the inlet flow path, the at least one tool flow path, and the exhaust flow path.

The downhole tool may comprise a borehole inclination measuring (drift) tool. Further features of the tool for generating a fluid pressure pulse are defined above.

According to a fifth aspect of the present invention, there is provided a method of controlling the operation of a downhole tool, the method comprising the steps of:

coupling a control mechanism to the downhole tool to define: an inlet flow path for fluid flow into a chamber of the mechanism; at least one tool flow path for fluid flow between the chamber and at least part of the downhole tool; and an exhaust flow path for fluid flow from the chamber to a fluid exhaust; and moving a control member of the mechanism within the chamber to control flow into and out of the chamber along the inlet flow path, the at least one tool flow path and the exhaust flow path.

According to a further aspect of the present invention, there is provided a downhole tool comprising:

a body defining a fluid flow path;

flow restriction means movably mounted in the body, for movement between a first position and a second position where fluid flow is restricted compared to the first position; and activating means including a member movable in a direction along a length of the body to cause the flow restriction means to move between the first and second positions.

Preferably, the downhole tool is for generating a fluid pressure pulse. The flow restriction means may be movable between the first and second positions to generate a fluid pressure pulse.

Advantageously, movement of the activating member controls fluid communication between, for example, the exterior of the tool and the flow restriction means, for moving the flow restriction means between the first and second positions. The flow restriction means may comprise a first or upper part which is movable in response to movement of the activating member, and a second or lower part which restricts the flow of fluid through the body when the flow restriction means is in the second position.

The flow restriction means may be generally in the form of a piston. Preferably, the flow restriction means comprises a piston assembly which is movable in a direction along a length of the body in response to applied fluid pressure. At least part of the piston assembly may be hollow to selectively allow fluid to pass therethrough, and at least part of the piston assembly may be mounted in a cylinder defined by the body. The piston assembly may include a first or upper piston part which is movable in response to applied fluid pressure and a second or lower piston part. The first piston part may be hollow. A piston rod may couple the first and second piston parts.

The body may comprise a generally tubular outer housing of the tool and may include a first fluid inlet through which fluid may enter the body. It will be understood that, when the tool is located in, for example, a drill string, fluid may partly flow around the tool, but that the major part of the fluid flow is through the first fluid inlet into the body, passing through the body and exhausting into the string at a downstream location. The flow restriction means, preferably the second piston part may close the first fluid inlet when the flow restriction means is in the second position. The body may include a separate, second fluid inlet through which fluid may enter the body for moving the flow restriction means between the first and second positions.

The activating means may include a bore in the body and the activating member may be movably mounted in the bore. Preferably, the activating means further comprises a hollow control body mounted in the tool body, the control body defining the bore. The control body may include a sleeve in which part of the piston assembly, preferably the upper piston part, is mounted, and one or more housing rings coupled to the sleeve. The sleeve may define a cylinder, and the one or more housing rings may define the activating member bore.

The activating means, in particular the control body, may include a control flow port for allowing selective supply of fluid to the bore. In use, fluid may be supplied from the body second fluid inlet and to the control flow port. Preferably, the activating means, in particular the control body, includes four control flow ports opening on to the bore and associated with respective first, second, third and fourth control fluid flow channels, which channels may be defined by the control body. The first fluid flow channel may be for supplying fluid to the bore through the first control fluid port, and the second, third and fourth fluid flow channels may be for allowing fluid communication between the bore and the flow restriction means through the second, third and fourth flow ports, respectively. The second fluid flow channel may couple a first end of the upper piston part to the bore and the third fluid flow channel may couple a second end of the upper piston part to the bore. Advantageously therefore, when fluid is supplied from the bore to one end of the upper piston part, fluid is returned from the other end to the bore, and vice versa. Thus it will be understood that by controlling the flow of fluid to and from the flow restriction means, the movement of the flow restriction means and thus the generation of a fluid pressure pulse may be controlled.

The tool may further comprise a chamber for storing fluid evacuated from the bore. In particular, the chamber may be for storing fluid returned to the bore through the second and third channels. The fourth fluid flow channel may couple the bore and the chamber. Conveniently, the fourth fluid flow channel couples the bore with the hollow interior of the upper piston part, for exhausting fluid through the upper piston part into the chamber. The chamber may be dimensioned to contain fluid discharged from multiple, for example, at least one hundred and fifty cycles of movement of the flow restriction means between the first and second positions.

The bore may comprise a number of secondary chambers, which chambers may be selectively fluidly isolated by the activating member. A number of seals may be provided in the bore, said seals, together with the activating member, defining the secondary chambers. The activating member may be movable with respect to the seals, and may define fluid flow paths which are selectively isolated by the seals. In particular, the activating member may comprise a generally cylindrical rod, the rod including cut-away or reduced dimension portions, which may straddle a seal to define a flow path and allow fluid communication therethrough depending upon the position of the activating member.

Preferably also, the tool further comprises pressure isolation means for isolating the part of the piston assembly from the pressure of fluid outside the tool. The pressure isolation means may include an isolation chamber at least partly containing a gas, which may be at surface atmospheric pressure. The upper piston part and/or an end of the piston rod may be mounted partly in the isolation chamber. The lower piston part may experience equal fluid pressure on opposite piston faces thereof. This may prevent hydraulic lock of the piston assembly.

The tool may further comprise drive means for moving the activating member, which drive means may include a drive motor. The motor is conveniently battery powered, and may be operative in response to an applied fluid pressure. This is particularly advantageous in that a drive means is provided which does not require, for example, control lines or power lines extending to surface, with the associated disadvantages which will be appreciated by the skilled person. The activating member may be in the form of a partly screw threaded rod, which may be rotated by the drive means to move in the direction along a length of the housing.

According to a still further aspect of the present invention, there is provided a downhole tool comprising:

a housing defining a fluid flow path;

flow restriction means movably mounted in a first chamber in the housing, for movement in response to applied fluid pressure between a first position and a second position where fluid flow is restricted compared to the first position; and activating means including a member movable to cause the flow restriction means to move between the first and second positions, whereby movement of the flow restriction means between the first and second positions displaces fluid from the first chamber into a second, storage chamber defined in the housing.

According to a yet further aspect of the present invention, there is provided a downhole tool comprising:

a body defining a fluid flow path;

flow restriction means movably mounted in the body, for movement between a first position and a second position where fluid flow is restricted compared to the first position;

activating means including a member movable to cause the flow restriction means to move between the first and second positions; and pressure isolation means for isolating at least part of the flow restriction means from the exterior of the tool.

Preferably, the downhole tool is for generating a fluid pressure pulse. The flow restriction means may be movable between the first and second positions to generate a fluid pressure pulse.

By this arrangement, the pressure isolation means advantageously prevents hydraulic lock of the flow restriction means, in use.

According to a yet further aspect of the present invention, there is provided a method of generating a fluid pressure pulse in a borehole, the method comprising the steps of:

locating a body in the borehole to define a fluid flow path through the body;

providing a movable flow restriction means in the body, movable between a first position and a second position where fluid flow through the body is restricted compared to the first position; and moving a flow restriction means activating member in a direction along a length of the body, to cause the flow restriction means to move to the second position, to restrict the flow of fluid through the body, generating a fluid pressure pulse.

The step of providing a movable flow restriction means may further comprise mounting a piston in the housing and selectively coupling the piston to a fluid pressure source. The step of moving the flow restriction means activating member may further comprise the step of coupling drive means to the activating member and activating the drive means to move the member. The fluid pressure pulse may provide an indication that the measurement of a desired parameter is to be transmitted, the magnitude of said measurement depending upon the length of time between pressure pulses. Thus the method may further comprise a method of transmitting data indicating the value of a desired parameter.

The step of moving the flow restriction member may further comprise the step of selectively supplying fluid to a first part of the flow restriction means whilst exhausting fluid from a second part of the flow restriction means.

It will be understood that one or more features of the above described aspects of the present invention may be provided singly or in combination.

BRIEF DESCRIPTION OF DRAWINGS

Embodiments of the invention will now be described, by way of example only, with reference to the accompanying drawings which are.

DETAILED DESCRIPTION OF DRAWINGS

Figure 1:
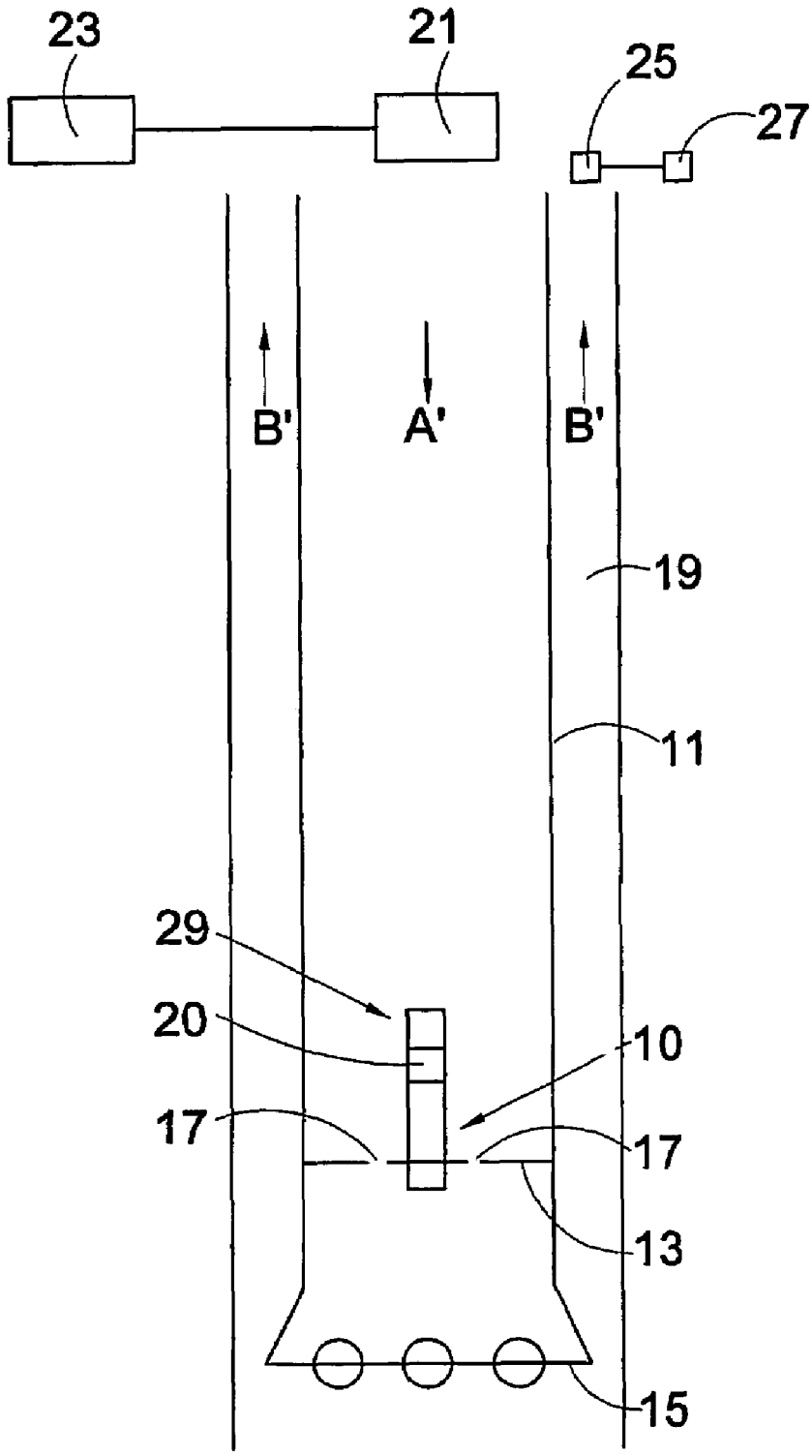
FIG. 1 a schematic illustration of a downhole tool incorporating a flow control mechanism in accordance with an embodiment of the present invention, the tool shown located in a drill string in a borehole.

Referring initially to FIG. 1, there is shown somewhat schematically a view of a downhole tool in accordance with an embodiment of the present invention, the tool indicated generally by reference numeral 10. The tool 10 takes the form of an Electronic Drift Tool (EDT) for use in measuring-while-drilling (MWD) techniques. The tool 10 is shown located within a string of tubing, typically a drill string 11, by a baffle 13 of a type similar to that disclosed in United Kingdom Patent Publication Number 2 334 732, the content of which is incorporated herein by reference. Drilling fluid (not shown) is pumped through the string 11 to a drill bit 15 in the direction of arrow A', before returning to surface through annulus 19, in the direction of arrows B', carrying entrained drill cuttings. Supply of the drilling fluid is controlled by a pump 21, whose operation is governed manually by the drill operator 23. A pressure sensor 25 measures the pressure of the fluid in the annulus 19, to detect a pressure pulse, and the measurements are recorded by a processor 27. The tool 10 includes an electronics package 29, which includes a pressure sensor, inclinometer, accelerometer and a processor (not shown), together with a drive means in the form of a motor 22, shown in FIG. 1A and which will be described in more detail below. The baffle 13 both locates the tool 10 in the drill string 11, and constrains flow through the string 11 to be directed through ports 17 in the baffle 13 and, selectively, through the tool 10. In fact, as will be described below, a major part of the fluid flow through the drill string 11 is directed through the tool 10, when the tool 10 is in an open position.

Figure 1A:
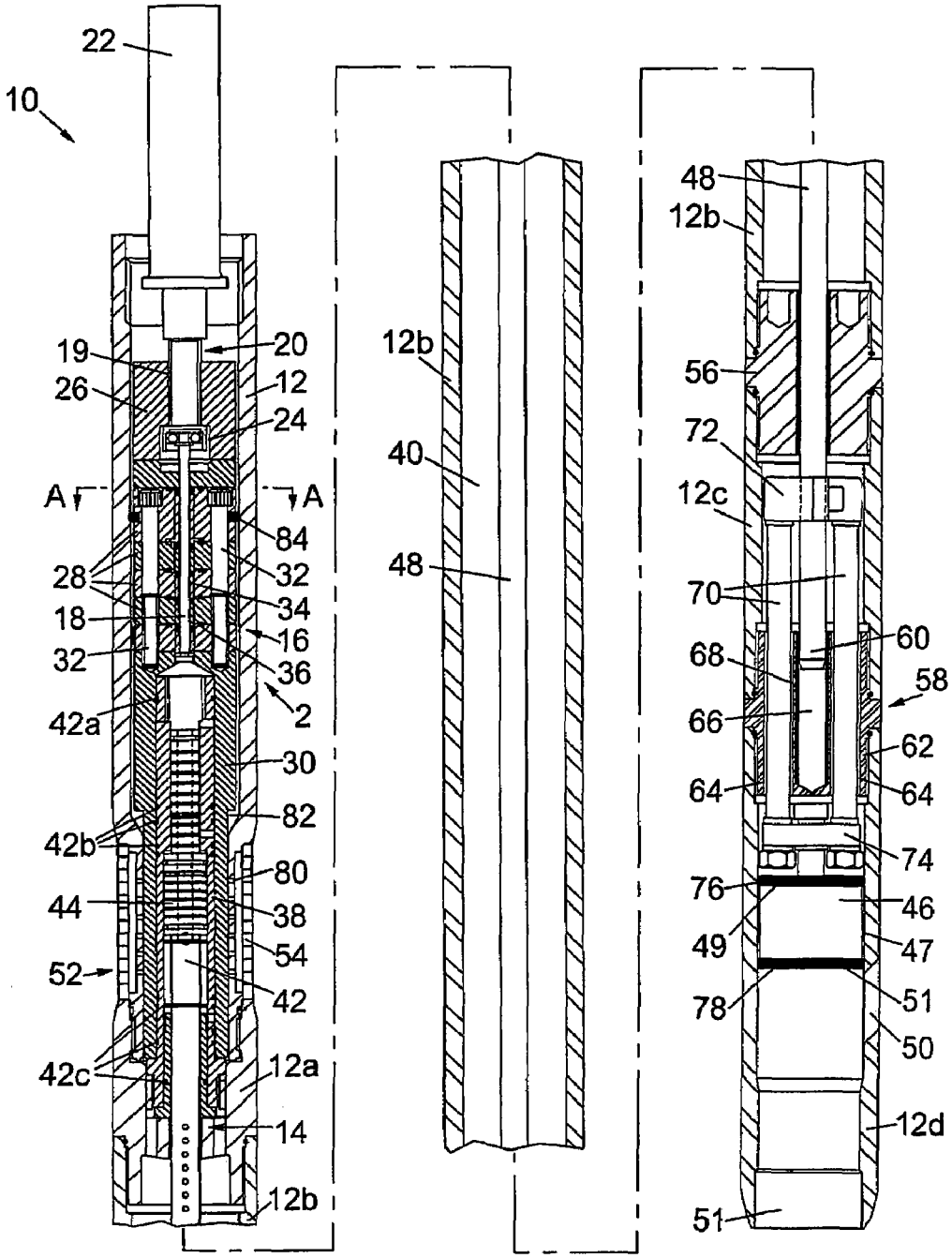
FIG. 1A an enlarged, longitudinal partial cross-sectional view of the downhole tool of FIG. 1, shown in an open position.

Referring now to FIG. 1A, there is shown a longitudinal cross-sectional view of the downhole tool 10 of FIG. 1 in more detail.

Figure 2:
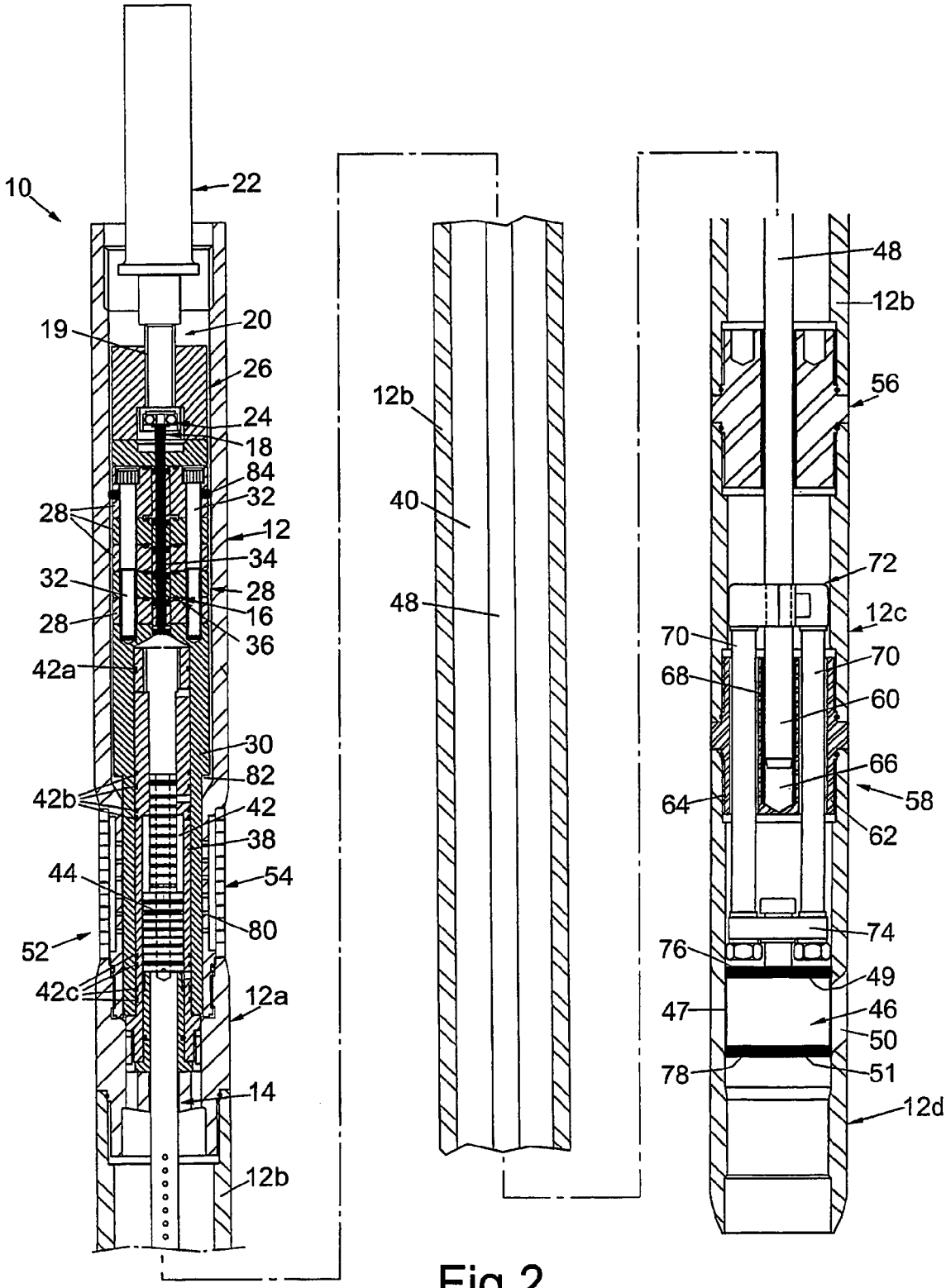
FIG. 2 a view of the downhole tool of FIG. 1, similar to the view of FIG. 1A but showing the tool in a closed position.

A control mechanism 2 in accordance with an embodiment of the present invention is provided as part of the tool 10. The control mechanism 2 includes a body in the form of an outer housing 12 of the tool 10, the body defining a chamber or inner bore 34; an inlet flow path 92 for fluid flow into the chamber 34; at least one tool flow path 94, 96 for fluid flow between the chamber 34 and part of the tool 10; an exhaust flow path 97, 112 for fluid flow from the chamber to a fluid exhaust 40; and control or activating means, indicated generally by reference numeral 16, which includes a control or activating member 18. The control member 18 is mounted for movement within the chamber 34 for controlling flow into and out of the chamber 34 along the inlet flow path 92, the at least one tool flow path 94, 96, and the exhaust flow path 97, 112, as will be described in more detail below. The control member 18 is movable along a length of the housing 12 to cause flow restriction means of the tool 10, comprising a piston assembly 14, to move between first and second positions. The tool 10 is shown in FIG. 1A in an open position, where the piston assembly 14 is in a first position and fluid flows through the housing 12. In FIG. 2, the piston assembly 14 is shown in a second position where the piston assembly 14 has moved to close the tool 10, to prevent fluid flow therethrough and thereby generate a fluid pressure pulse.

Figure 2A:
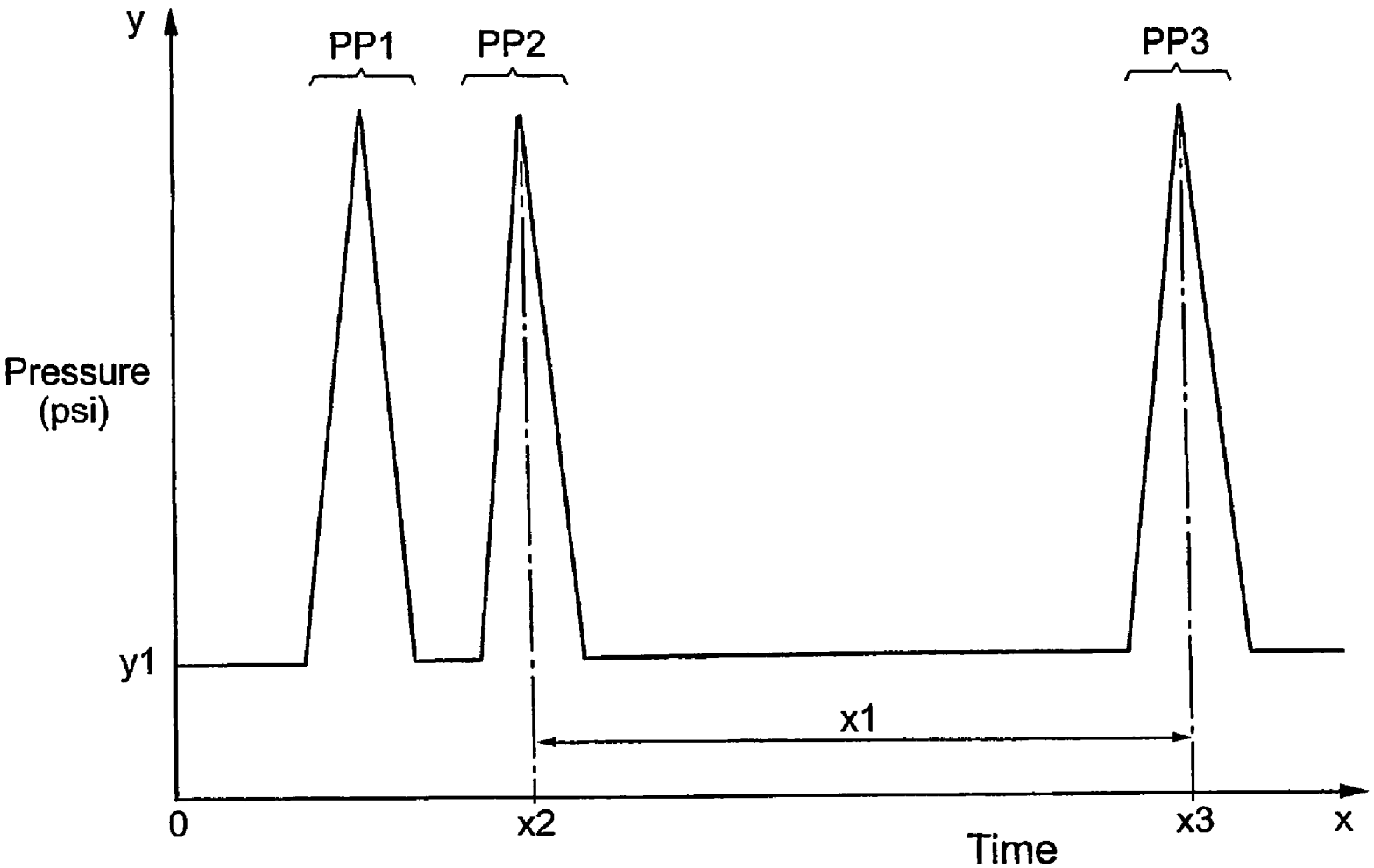
FIG. 2A a graphical illustration of generation of fluid pressure pulses using the tool of FIG. 1.

The structure of the tool 10 will now be described in more detail, viewing FIGS. 1A and 2 top to bottom. At an upper end of the tool 10, drive means 20 are provided for moving the control member 18. The drive means 20 includes a fluid activated electric motor 22 powered by a battery (not shown) in the tool 10, and a bearing and gearing assembly 24. The control member 18 takes the form of a needle valve or activating rod, which is threaded at 19 and extends through an internally threaded upper guide housing 26. When the motor 22 is activated, the motor 22 rotates the rod 18, moving the rod 18 longitudinally along the housing 12 between the positions of FIGS. 1A and 2A. The motor 22 is fluid activated according to the pressure of the fluid in the drill string 11.

The control means 16 includes a control body which comprises five annular seal housing rings 28 and a lower sleeve assembly 30 defining a cylinder. Each of the seal housing rings 28 are secured together and to the sleeve assembly 30 by high tensile cap screws 32, which ensure correct rotational orientation of the rings 28. The rings 28 together define the chamber or inner bore 34 in which the rod 18 is located, and a number of seals 36 are provided between the rings 28 to seal the chamber 34.

Figure 1B:
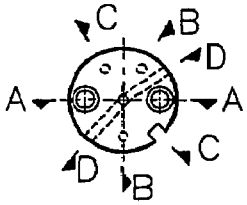
FIG. 1B a schematic cross-sectional view of part of the downhole tool of FIG. 1A, taken along line A-A of FIG. 1A.
Figure 1C:
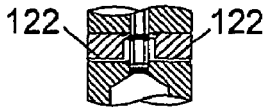
FIG. 1C an enlarged view of part of the downhole tool of FIG. 1A, taken along line D-D indicated in FIG. 1B.
Figure 1D:
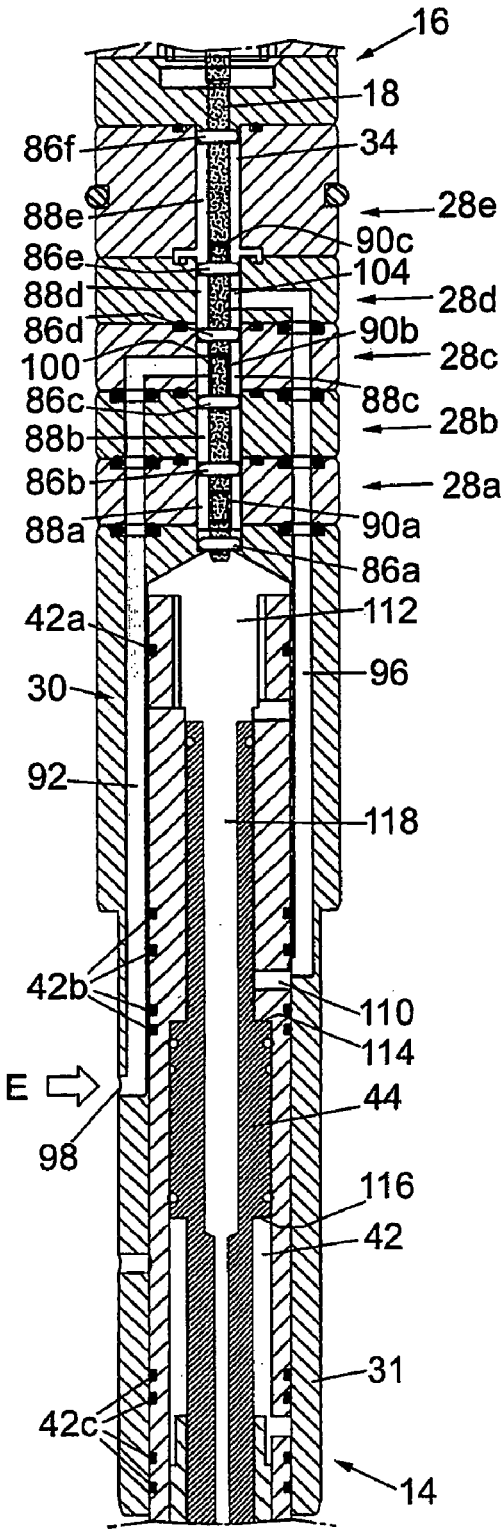
FIGS. 1D and 1E further enlarged views of part of the tool of FIG. 1, taken along lines B-B and C-C of FIG. 1B, respectively.
Figure 1E:
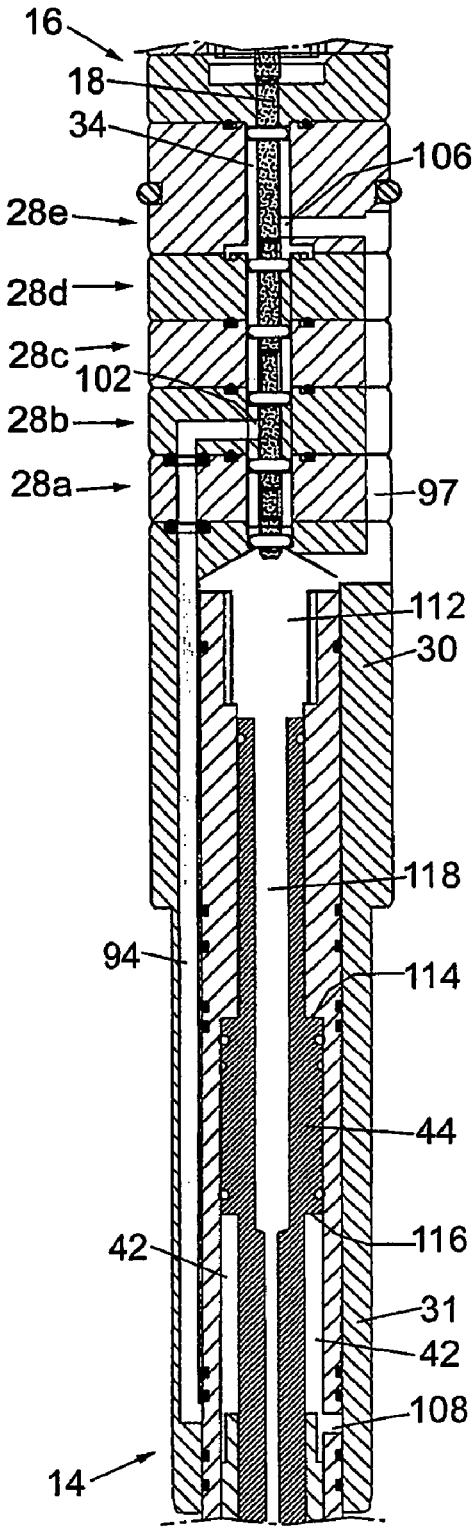

Referring now also to FIGS. 1D and 1E, there are shown enlarged views of part of the tool 10, taken along lines B-B and C-C of FIG. 1B, respectively. The sleeve assembly 30 includes an outer sleeve 31 and an inner sleeve 38, which defines a cylinder 42 in which part of the piston assembly 14 is located. The outer sleeve 30 and inner sleeve 38 are located by a sub 12*a* of the housing 12, which is in turn, coupled to a lower housing part 12*b*, and the housing part 12*b* defines the fluid exhaust which comprises a chamber 40, as will be described below. The inner sleeve 38 carries a number of sets of seals 42*a*, 42*b* and 42*c*, for sealing the inner sleeve 38 and for directing fluid into the cylinder 42.

The piston assembly 14 includes an upper piston part 44 and a lower piston part 46 (shown to the right in FIGS. 1A and 2), coupled together by a hollow piston rod 48. When the tool 10 is open (FIG. 1A), fluid enters a muleshoe 12*d* of the housing 12 through a first flow port 50, flowing along the housing 12, exhausting through a lowermost outlet 51 and flowing to the drill bit 15. Movement of the piston assembly 14 between the open position and the closed position (FIG. 2), controlled by the control mechanism 2, moves the lower piston part 46 to close the first flow port 50, increasing annulus fluid pressure to generate a fluid pressure pulse. The piston part 46 includes a solid wall 47, whilst the end faces 49, 53 include apertures to allow fluid flow axially through the piston to a pressure isolation unit 58, which will be described below. Fluid is supplied to the control mechanism 2 to move the tool 10 between the first, open position and the second, closed position through an inlet path entrance port comprising a second tool fluid inlet 52. The inlet 52 is defined by an upper end of the sub 12*a* that carries a filter 54 for removing relatively large particles from the drilling fluid.

The housing part 12*b* is coupled to a lower housing part 12*c* through a threaded, hollow seal end housing unit 56. This unit 56 seals the fluid exhaust chamber 40 and the piston rod 48, to prevent fluid escape from the chamber 40 during movement of the rod 48. Below the seal end housing unit 56, pressure isolation means in the form of a pressure isolation unit 58 isolates a lower end 60 of the piston rod 48, and thus the upper piston part 44, from the pressure of fluid outside the tool 10. This allows the upper piston part 44 to move and prevents hydraulic lock.

The pressure isolation unit 58 includes a threaded housing 62 which couples the housing part 12*c* to the muleshoe 12*d*, and which includes two passages 64 and a pressure isolation chamber 66. The pressure isolation chamber 66 carries a seal 68 in which the lower end 60 of the piston rod 48 is moveably mounted, and is charged with a gas at surface pressure, before the tool 10 is run downhole. The passages 64 receive connecting rods 70, which secure the lower piston part 46 to the piston rod 48 through upper and lower piston connectors 72 and 74, respectively. Both the rods 70 are free to move within the passages 64, and are unsealed for fluid communication through the annulus between the outer surface of the rods 70 and the inner surface of the passages 64. This ensures that the pressure of the fluid on the upper and lower faces 76 and 78 of the lower piston part 46 are equal, to prevent hydraulic lock-up of the upper piston part 44. During movement of the upper piston part 44 to the second, closed position of FIG. 2, the lower end 60 of the piston rod 48 compresses the gas in the pressure isolation chamber 66.

In general terms, operation of the tool 10 to move between the open position of FIG. 1A and the closed position of FIG. 2 is achieved in the following fashion. Fluid is supplied to the chamber 34 carrying the rod 18 from the drill string 11, through the second fluid inlet 52. Fluid supply from the chamber 34 into the cylinder 42 carrying the upper piston part 44 depends upon the longitudinal position of the rod 18. Thus, movement of the rod 18 in a direction along the length of the housing 12 selectively supplies and exhausts fluid to the cylinder 42. This moves the upper and lower piston parts 44 and 46 to close the first fluid inlet 50 (FIG. 2), which prevents fluid flowing through the muleshoe 12*d* to the drillbit 15. In this fashion, fluid flow is constrained to be directed through the baffle 13 only. This restricts the flow of fluid through the drill string 11, increasing fluid pressure and generating a fluid pressure pulse. Typically, the tool 10 is held in a closed position only for a short duration to generate the pressure pulse. This is illustrated graphically in FIG. 2A, which is a graph of annulus pressure (measured by pressure sensor 25) against time. The annulus pressure during a drilling operation (y1 psi) is typically in the region of 500 psi to 10,000 psi, depending upon the depth of the borehole (and thus the hydrostatic pressure). When it is desired to transmit data such as borehole inclination, measured by sensors in the electronics package 29, the tool 10 is closed (FIG. 2), restricting fluid flow in the string 11, increasing fluid pressure, and generating first fluid pressure pulse PP1. When detected at surface, this indicates that a measurement is about to be transmitted. The tool 10 is reopened (FIG. 1A) and closed again to generate pressure pulse PP2, which indicates the start of a measuring period. The tool 10 is then reopened once more, before a final pressure pulse PP3 is generated, indicating the end of the data transmission. The magnitude of the parameter (for example, borehole inclination) transmitted is determined by measuring the peak to peak time x1 between the pulses PP2 and PP3, which is equal to x3−x2. Alternatively, the time may be measured between return of fluid pressure to level y1.

The structure and operation of the tool 10 will now be described in more detail with reference in particular to FIGS. 1D, 1E and FIGS. 3A to 4B. As shown in FIG. 1A, fluid enters the tool 10 through the second fluid inlet 52, passing through filter 54 and into an annulus 82 defined between the sleeve 30, seal housing rings 28 and the outer housing 12. A seal 84 is provided to seal an upper end of the annulus 82. In a similar fashion, a seal (not shown) at a lower end of the annulus 82 directs fluid into the chamber 34. In FIGS. 1D and 1E, the five seal housing rings 28 have been numbered 28*a*-28*e*, respectively, for ease of reference. Six annular seals 86*a*-86*f* are mounted in the chamber 34 and the control rod 18 is slidable within the seals between the positions of FIGS. 1A and 2. Each respective pair of seals 86*a/b*; 86*b/c*; 86*c/d*; 86*d/e*; and 86*e/f* separates the chamber 34 into a number of secondary chambers 88*a*-88*e*, respectively. These chambers 88*a*-88*e* are isolated by the control rod 18, depending upon its longitudinal position. The rod 18 includes cut-away portions 90*a*, 90*b* and 90*c*, which are of reduced outer diameter compared to the remainder of the rod 18. Depending upon the position of the rod 18, these portions 90*a*-90*c* straddle respective ones of the seals 86*a*-86*e*, to allow fluid communication between adjacent chambers 88*a*-88*e*.

Also, the outer and inner sleeves 30 and 38, together with the various seal housing rings 28*a*-28*e*, define the inlet flow path 92, tool flow paths 94, 96 and the exhaust flow paths 97, 112. The inlet flow path 92 includes an inlet flow port 100 opening onto the chamber 34. The tool flow path 94 defines a first tool flow path including a first tool flow port 102 opening onto the chamber 34 and a cylinder port 108 opening onto the cylinder 42. In a similar fashion, the tool flow path 96 defines a second tool flow path including a second tool flow port 104 opening onto the chamber 34 and a cylinder port 110, whilst the exhaust flow path 97 defines an exhaust flow port 106 opening onto the chamber 34, and this channel 97 communicates with an upper end 112 of the cylinder 42. The cylinder end 112 also forms an exhaust flow path in selective communication with a lower end of the chamber 34, as will be described below.

Figure 3A:
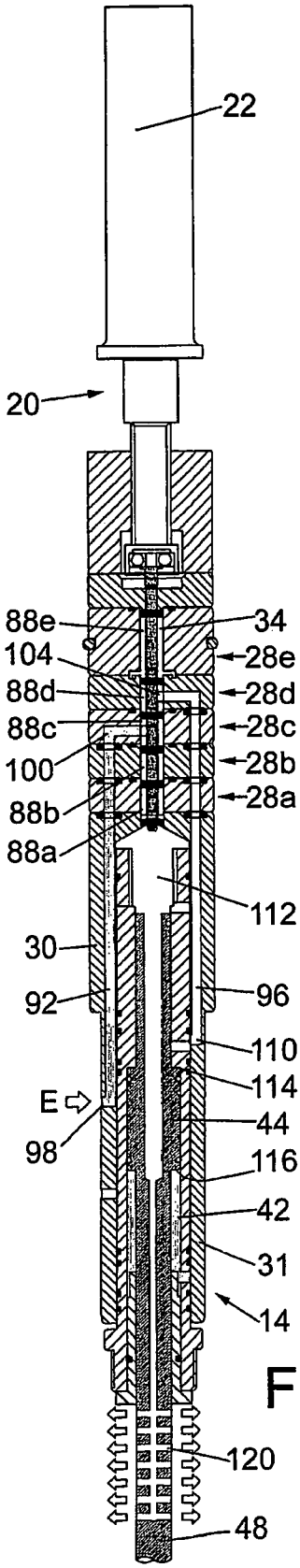
FIGS. 3A and 3B enlarged views of part of the downhole tool shown in the open position of FIG. 1A.
Figure 3B:
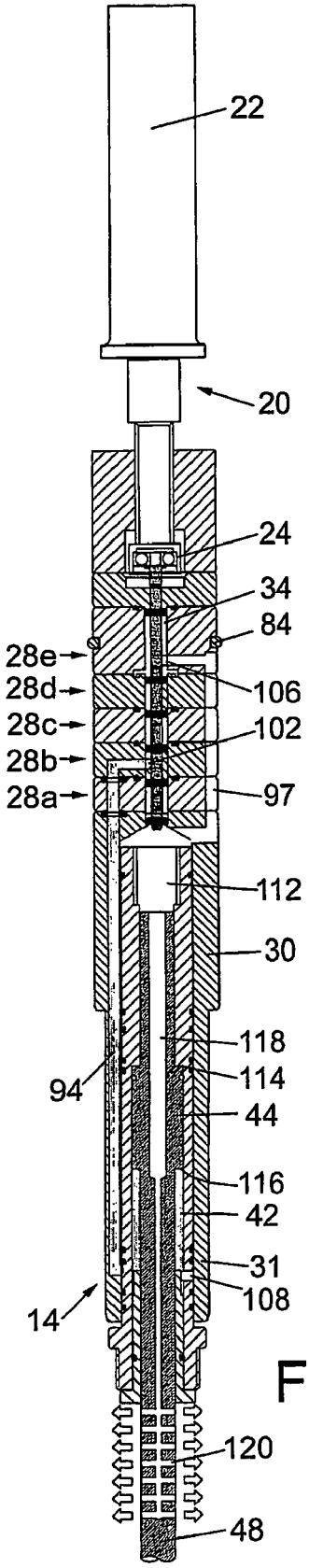
Figure 4A:
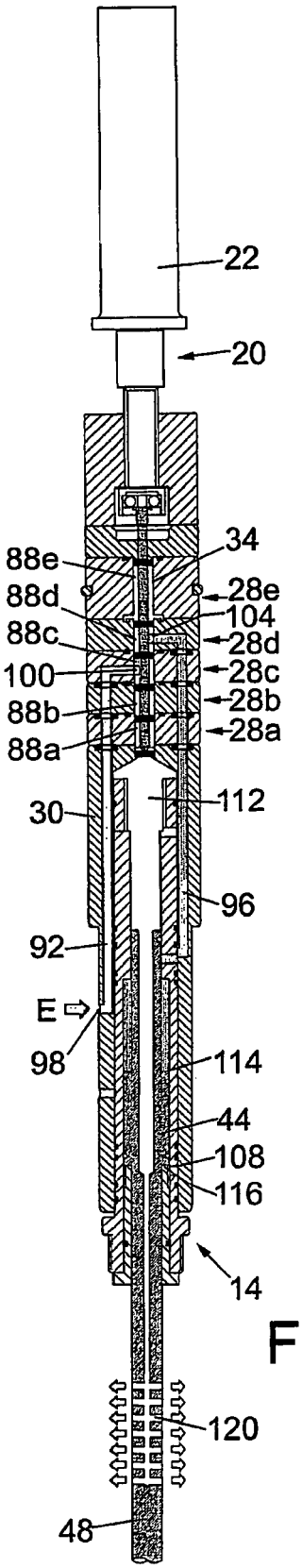
FIGS. 4A and 4B enlarged views of part of the downhole tool shown in the closed position of FIG. 2.
Figure 4B:
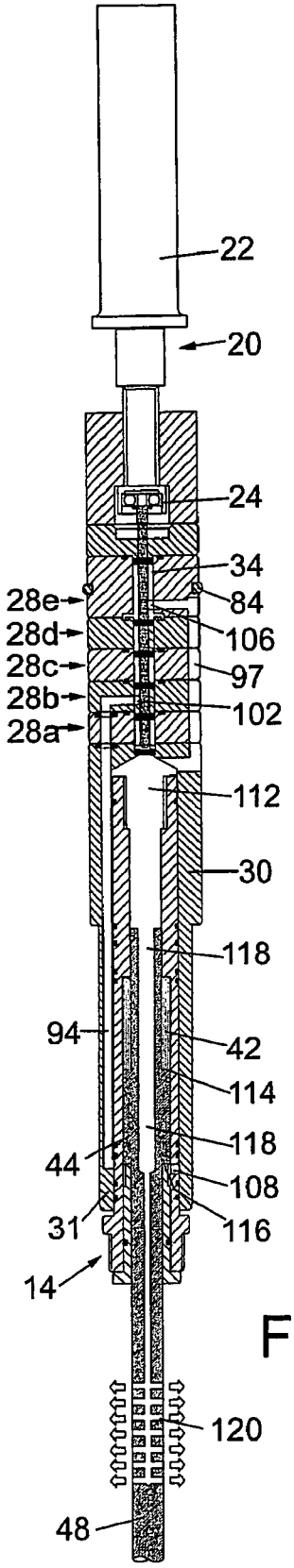

FIGS. 3A and 3B show part of the tool 10 in the open position of FIG. 1A, and FIGS. 4A and 4B show the tool in the closed position of FIG. 2. FIGS. 3A and 4A are sectional views on line B-B of FIG. 1B, whilst FIGS. 3B and 4B are sectional views on line C-C of FIG. 1B.

To move the tool 10 to the closed position, where the first fluid flow port 50 is closed, generating a pressure pulse, the motor 22 is activated to move the control rod 18 longitudinally in a direction towards the motor 22, to the position of FIGS. 4A and 4B. In this position, the cut-away portion 90*b* straddles the seal 86*d*, allowing flow between chambers 88*c* and 88*d*. This allows fluid to flow through the inlet flow path 92, through the inlet flow port 100 into the second tool flow port 104, along the second tool flow path 96, before discharging into the cylinder 42. This fluid acts against an upper piston face 114 of the upper piston part 44 (FIG. 4A).

Simultaneously, the cut-away portion 90*a* straddles seal 86*b*, allowing flow between the chambers 88*b* and 88*a*. Therefore when fluid is supplied to the cylinder 42 through the second tool flow path 96, fluid is simultaneously exhausted from the cylinder 42, by downward movement of the upper piston part 44. This fluid flows through the port 108, through the first tool flow path 94 and into the chamber 34 through the first tool flow port 102. This fluid is then exhausted across seal 86*b* and out of chamber 88*a* into the exhaust path defined by the upper end 112 of the cylinder 42. The exhausted fluid flows through the inner bore 118 of the upper piston part 44, and through exhaust ports 120 into the fluid exhaust chamber 40, which is under a vacuum (reduced pressure) or contains gas at surface pressure. This movement of the upper piston part 44 brings the lower piston part 46 to the closed position of FIG. 2, generating the pressure pulse.

When it is desired to re-open the housing 12, the upper piston part 44 is returned to the first position shown in FIGS. 3A and 3B. This is achieved by activating the motor 22 to rotate the control rod 18 in the opposite direction, to move it longitudinally downwardly away from the motor 22. In this position, the cut-away portion 90*b* now straddles the seal 86*c*, allowing flow from chamber 88*c* to chamber 88*b*. Fluid supplied to the chamber 34 through the inlet flow port 100 thus travels across seal 86*c* and enters the first tool flow path 94 through the first tool flow port 102. This fluid is supplied through port 108 into the cylinder 42 to act against a lower piston face 116 of the upper piston part 44 (FIG. 3A).

Simultaneously, the cut-away portion 90*c* is moved to a position where it straddles the seal 86*e* (FIG. 3B), allowing flow across the seal 86*e* from chamber 88*d* to chamber 88*e*. This allows fluid to be exhausted from the cylinder 42 through the port 110, along the second tool flow path 96 and into the chamber 34, through the second tool flow port 104. The fluid travels across the seal 86*e* and into the exhaust flow path 97 via the exhaust flow port 106. Therefore this fluid is exhausted from the cylinder 42, through the chamber 34 and into the upper end 112 of the cylinder 42, through inner bore 118 of the upper piston part 44 and into the exhaust chamber 40.

The exhaust chamber 40 is of a volume sufficient to contain fluid discharged from a large number of such cycles of the tool 10—typically of the order of 150 cycles. This is advantageous in that this allows multiple cycles of pressure pulses (and therefore transmission of data to surface) to be carried out before the tool 10 is pulled out of hole and the exhaust chamber 40 emptied ready for further use. As shown in FIG. 1C, optional backup safety bleed ports 122 may be provided to provide a safety bleed from the cylinder 42 to annulus preventing surge.

Figure 5:
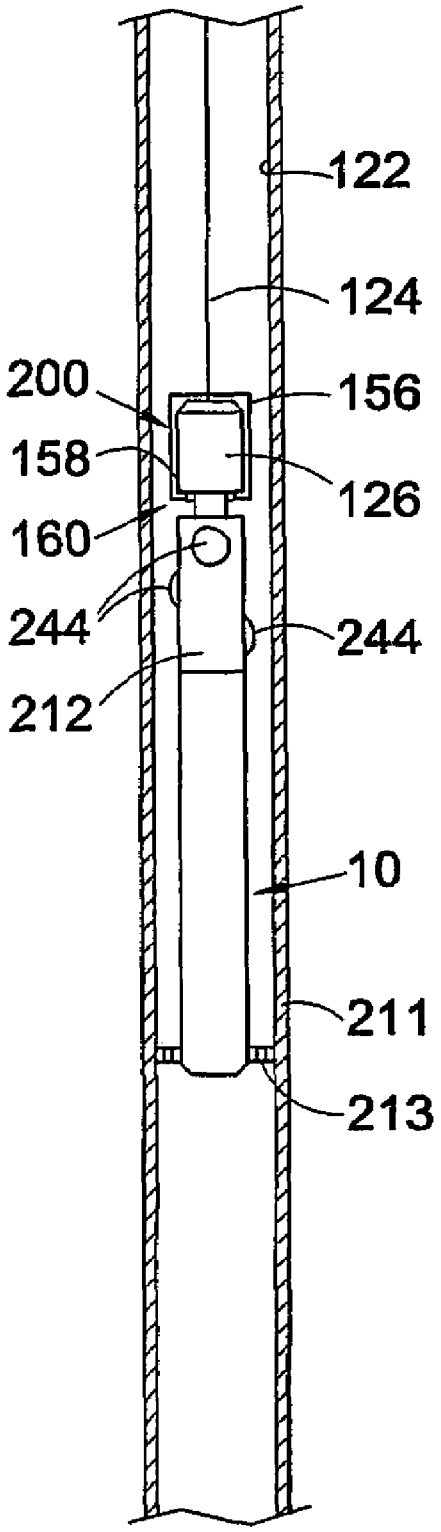
FIG. 5 a schematic illustration of a downhole tool including a flow control mechanism in accordance with an alternative embodiment of the present invention, the tool shown located in a drill string in a borehole in a deactivated position.

Turning now to FIG. 5, there is shown a downhole tool in accordance with an alternative embodiment of the present invention, the tool indicated generally by reference numeral 200 and comprising a centraliser. Like components of the centraliser 200 with the drift tool 10 of FIGS. 1-4B share the same reference numerals incremented by 200. As will be described below, the centraliser 200 includes a control mechanism 202 in accordance with an alternative embodiment of the present invention, similar to the control mechanism 2 of the downhole tool 10.

The centraliser 200 is shown in FIG. 5 coupled to the drift tool 10 of FIGS. 1-4B, for centralising the tool 10 within a drill string 211, similar to the string 11 illustrated in FIG. 1. This ensures accurate inclination measurements of the borehole are obtained. The centraliser 200 is moveable between a deactivated position shown in FIG. 5, and an activated position shown in FIG. 6 where fluid activated members comprising three centralising pistons 244 are urged radially outwardly to engage a wall 122 of the drill string 211. The centraliser 200 is moved to the activated position under the control of the control mechanism 202, which will now be described, in conjunction with a wireline 124.

Figure 7:
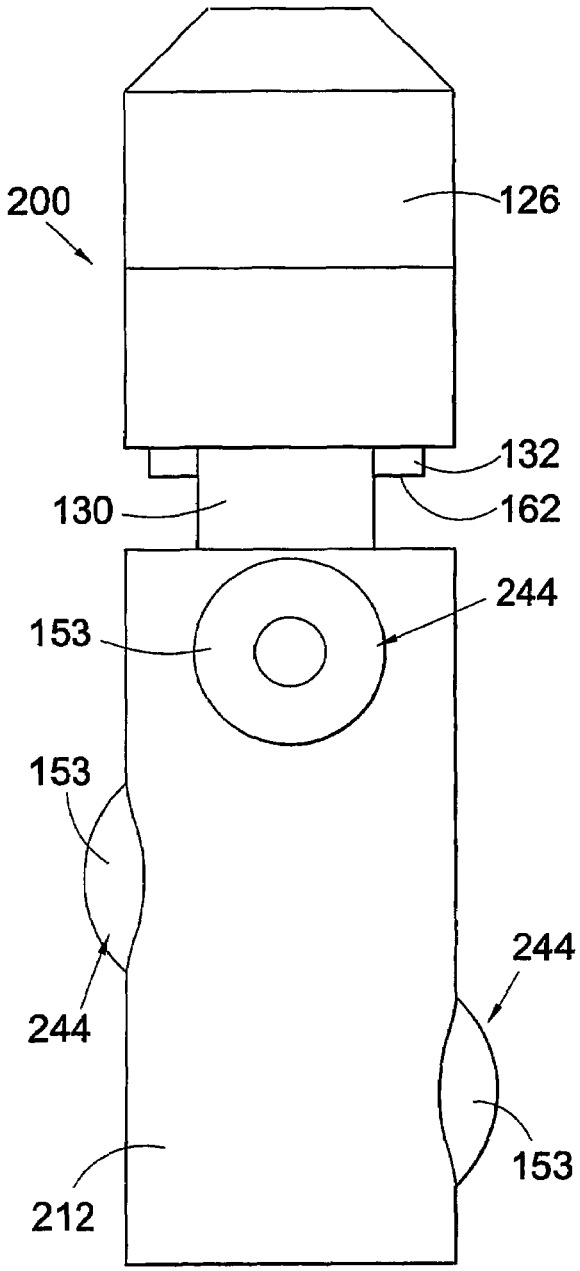
FIG. 7 an enlarged view of the downhole tool of FIG. 5.
Figure 8:
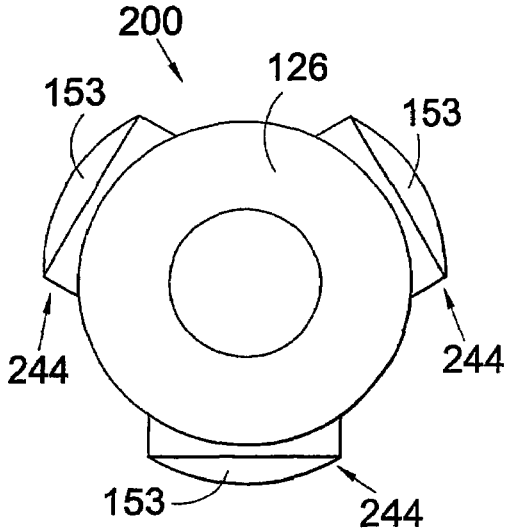
FIG. 8 a top view of the downhole tool shown in FIG. 7.
Figure 9:
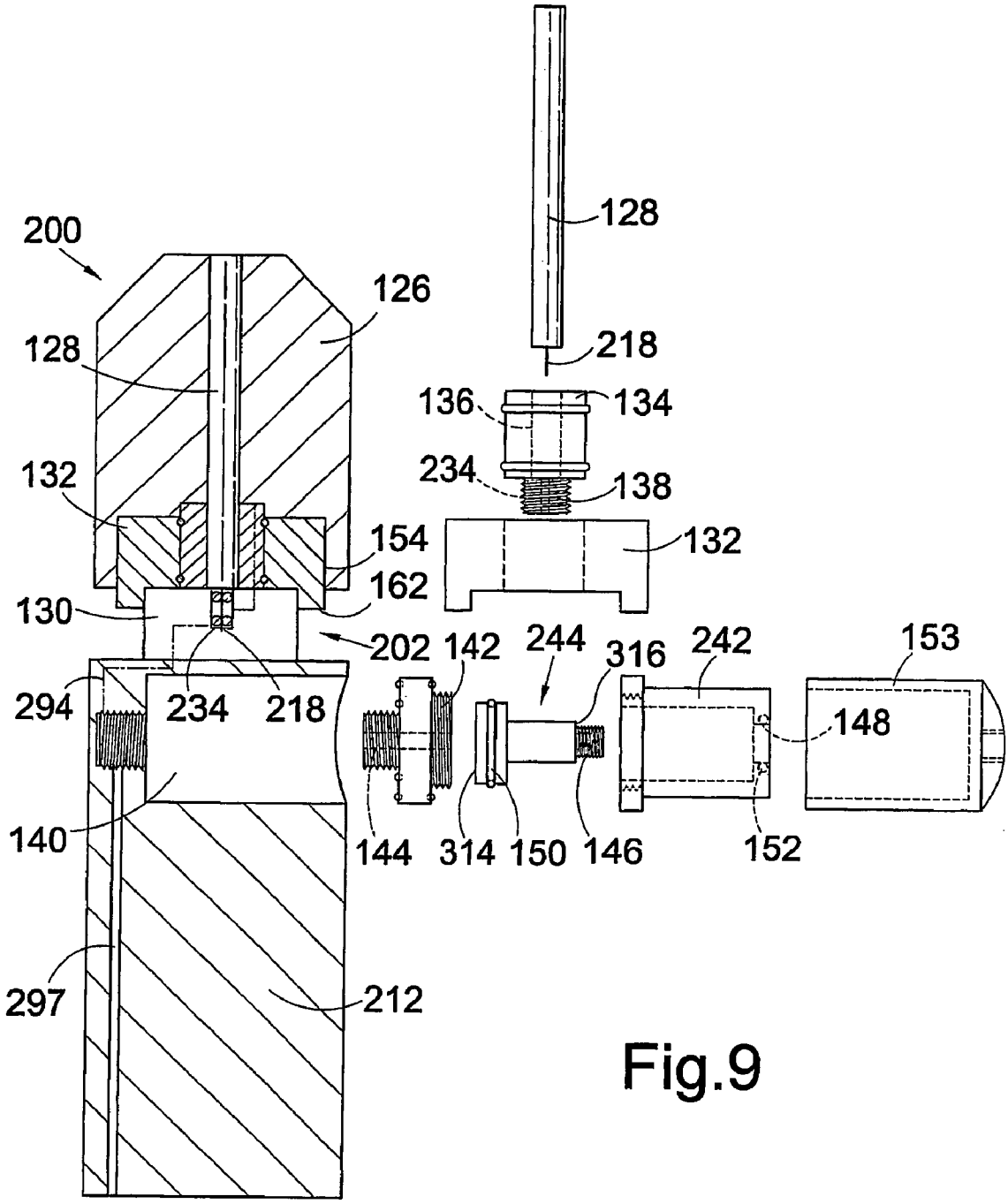
FIG. 9 a partially sectioned exploded view of the downhole tool shown in FIG. 7.

The centraliser 200 is shown in more detail in the enlarged view of FIG. 7 and in FIG. 8, which is a top view of the centraliser shown in FIG. 7. The pistons 244 are shown in FIGS. 7 and 8 in a retracted position and are rotationally spaced 120° apart around the centraliser 200 and axially staggered. The control mechanism 202 is shown in more detail in FIG. 9, which is a partially sectioned, exploded view of the centraliser 200. For clarity, only one of the centraliser pistons 244 is shown in FIG. 9.

Figure 10:
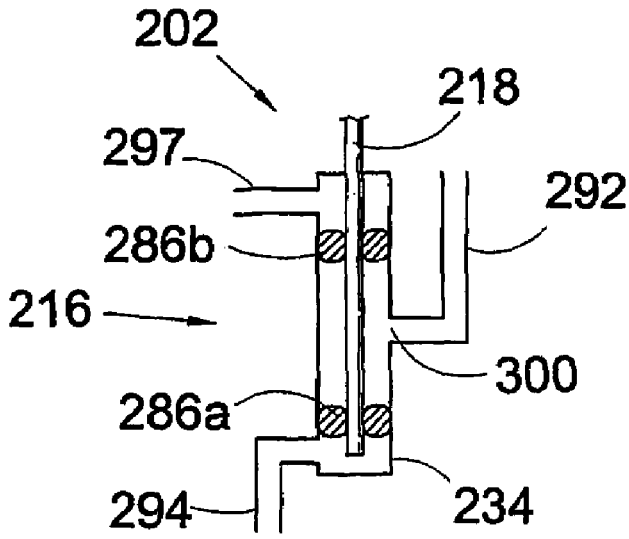
FIG. 10 a schematic illustration of part of the flow control mechanism of the downhole tool shown in FIG. 7.

The flow control mechanism 202 controls the operation of the centraliser 200 and includes a body 212 defining a fluid chamber 234, also shown in the enlarged schematic view of FIG. 10. The mechanism 202 also includes an inlet flow path 292 for fluid flow into the chamber 234, at least one tool flow path in the form of tool flow path 294 for fluid flow between the chamber 234 and part of the centraliser 200, and an exhaust flow path 297 for fluid flow from the chamber 234 to a fluid exhaust in the form of an exhaust chamber 240 (FIG. 13), which is sealed from well pressure. Control means 216 of the mechanism 202 includes a moveable control rod or needle valve 218 mounted for movement within the chamber 234, for controlling flow into and out of the chamber 234 along the inlet flow path 292, the at least one tool flow path 294 and the exhaust flow path 297.

Figure 6:
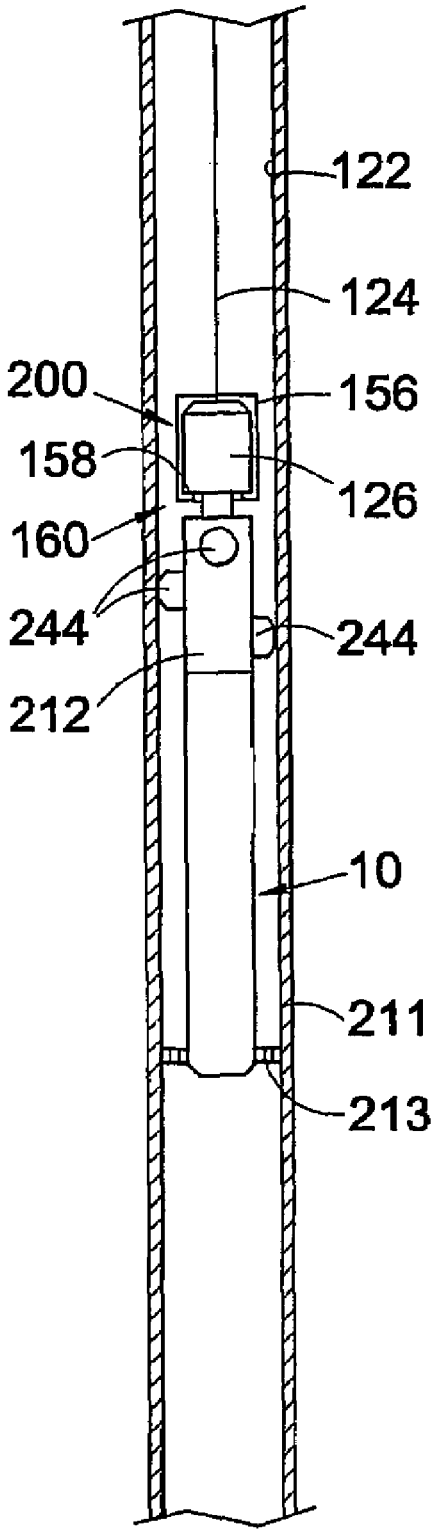
FIG. 6 a view of the downhole tool of FIG. 5 in an activated position.

Each centraliser piston 244 is mounted in a cylinder 242 for movement between the retracted and extended positions of FIGS. 5 and 6. The piston 244 is coupled to the chamber 234 through the tool flow path 294, for selectively exposing the piston 244 to hydrostatic wellbore pressure, to urge the piston 244 radially outwardly for engaging the wall 122 of the drill string 211. This movement is controlled by movement of the control rod 218 within the chamber 234.

In more detail, the centraliser 200 includes an upper housing 126 and a shaft 128 coupled to the control rod 218 and threaded to the upper housing 126 for movement together. The upper housing 126 is coupled to the body 212 and moveable in an axial direction on a stub 130 of the body 212. This movement of the housing 126 causes a corresponding movement of the control rod 218 within the chamber 234. An annular collar or plug 132 is mounted around the stub 130 and is moveable independently of the upper housing 126, and a hollow body 134 is movably mounted within the plug 132 and threaded to the stub 130. The body 134 defines a passage 136 in which the control rod shaft 128 is movably mounted and a threaded coupling 138 of the body 134 defines the chamber 234. The control rod 218 is mounted within the chamber 234 for movement with respect to first and second seal elements 286*a*, 286*b* which sealingly engage the control rod.

Figure 11:
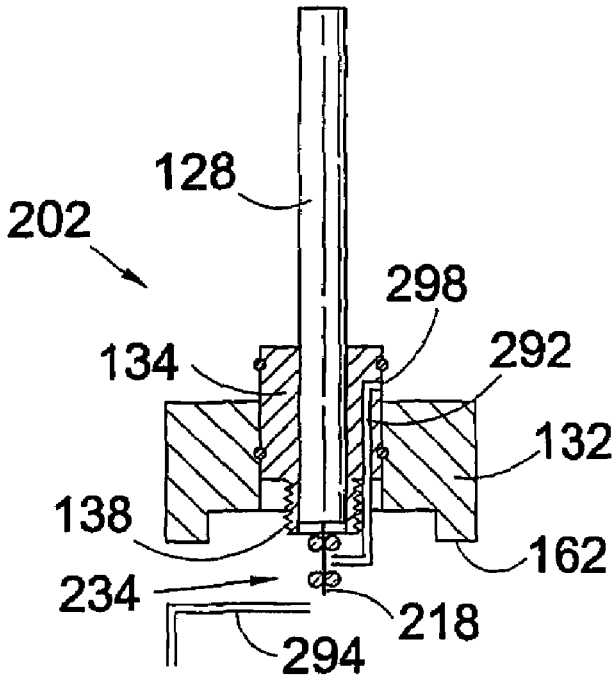
FIGS. 11, 12 and 13 schematic views of parts of the downhole tool of FIG. 7 shown at various stages in a procedure of operating the tool.

As shown in FIG. 10 and the enlarged view of FIG. 11, the inlet flow path 292 extends through the body 134 and includes an inlet flow port 300 opening onto the chamber 234 and an entrance flow port 294 allowing fluid flow into the inlet flow path 292. In the deactivated position of FIG. 9, the entrance flow port 298 is closed by the plug 132, as will be described below. The entrance flow port 298 is closed during running-in of the centraliser 200. This prevents the centraliser 200 from being inadvertently activated during run-in to the borehole.

The stub 130 includes an annular groove (not shown) in an upper surface forming part of the inlet flow path 292. This facilitates connection of the body 134 to the stub 130 as the rotational orientation of the body 134 to the stub 130 as the rotational orientation of the body 134 does not need to be precisely determined; the groove ensures the inlet flow path in the stub 130 and body 134 are fluidly coupled.

Each piston 244 is mounted in an opening 140 in the tool body 212 and a threaded housing connector 142 is mounted and sealed in the opening 140. The housing connector 142 is threaded to the body 212 and defines a passage 144 fluidly coupling the piston 244 to the tool flow path 294, which opens into the opening 140. The piston cylinder 242 is provided as a housing which is threaded and sealed to the housing connector 142 surrounding the piston 244 and the piston 244 includes a threaded stub 146 which extends through an opening 148 in an end of the cylinder housing 242. The piston 244 includes a first O-ring seal 150 which is larger than a second O-ring seal 152 mounted in the opening 148 and thus defines a larger piston area than the seal 152. A protective cover 153 is threaded to the piston stub 146 and defines an abutment surface for abutting and engaging the drill string wall 122. The cylinder 242 is charged with a gas, typically air at surface atmospheric pressure, before the centraliser 200 is run into the borehole. Thus, when a first face 314 of the piston 244 is exposed to hydrostatic well pressure, the seal 150, which is larger than the seal 152, causes a pressure force to be exerted on the piston face 314, which is greater than that exerted on the piston face 316, such that the piston 244 is urged radially outwardly to the extended position of FIG. 6, engaging the drill string wall 122.

Figure 12:
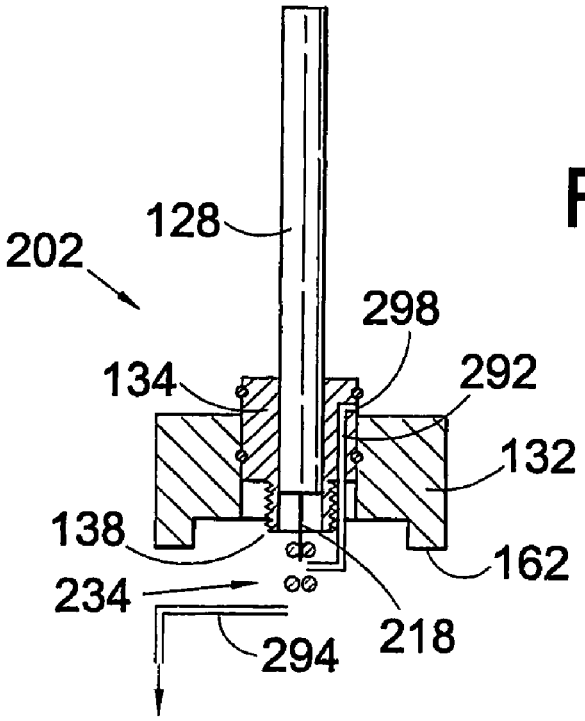
Figure 13:
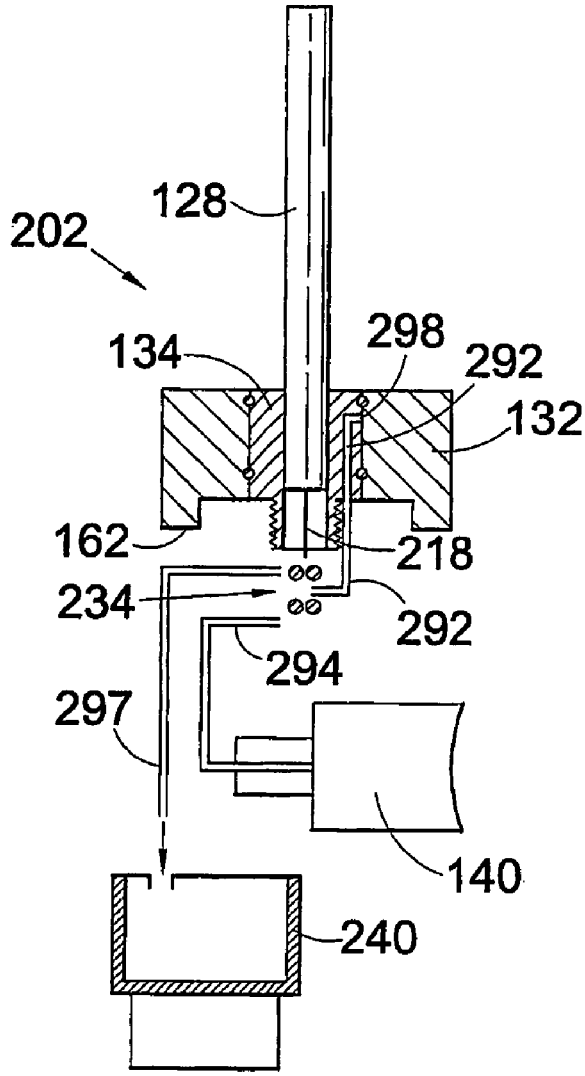

The method of operation of the centraliser 200 will now be described in more detail, with reference to FIGS. 11-13, which are enlarged, schematic illustrations of parts of the centraliser 200. In the running-in position of the centraliser 200 of FIG. 5, the upper housing 126 and thus the control rod shaft 128 and the control rod 218 are locked to the tool body 212. In this position, the inlet path entrance port 298 is open, however, the control rod 218 seals against the seal elements 286*a*, 286*b*, as shown in FIG. 10, to both close the tool inlet flow path 292 and the exhaust flow path 297. Thus, although the inlet path entrance port 298 is open, there is no flow through the chamber 234.

When the downhole tool 10 has been located in a baffle 213 in the drill string 211, a locking mechanism (not shown) releases the upper housing 126. A release tool 156 is mounted around the upper housing 126 and is located in an undercut 160 engaging a lower shoulder 158 of the housing. The release tool 156 is mounted on the wireline 124 and is moved upwardly by the wireline 124, to carry the upper housing 126 a short distance upwardly with respect to the tool body 212. Through the connection between the control rod shaft 128 and the control rod 218, this moves the control rod 218 upwardly from the first, closed position of FIGS. 9, 10 and 11 to a second position, illustrated in FIG. 12 where there is a gap between an upper surface of the plug 132 and the upper housing 126. In this position, the control rod 218 has moved past the lower seal 286*a*, opening flow along the inlet flow path 292 into the chamber 234. Fluid enters the inlet entrance port 298 along an annulus 154 (FIG. 9) defined between the plug 132 and the upper housing 126. This provides communication through the chamber 234 and along the tool flow path 294. The tool inlet entrance port 298 is open to hydrostatic well pressure, therefore the piston 244 now experiences well pressure on the piston face 314, and is urged radially outwardly. Similar movement of each of the other pistons 244 centralises the body 212 of the centraliser 200 and thus the downhole tool 10 within the drill string 211. It will be understood that the hydrostatic pressure of fluids in the drill string 211 are sufficient to activate the pistons 244, and thus that no fluid flow through the string is necessary. The centraliser 200 will operate at a pressure of as low as 250 psi and in a range of 250 to 10,000 psi. However, the centraliser 200 operates in fluid flow environments such as is typical downhole. When the centraliser 200 is in the activated position of FIG. 6, the centraliser 200 exerts a sufficiently large force on the string wall 122 to clamp the drift tool 10 centrally within the string 211, and also resists the axial movement of the drift tool 10.

When it is desired to deactivate the centraliser 200, it is necessary to move the pistons 244 to the retracted positions of FIG. 5. This is achieved by engaging the release tool 156 in the undercut 160 in engagement with a lower shoulder 162 of the plug 132, as shown in FIG. 6. A second upward movement of the release tool 156 initially carries the plug 132 upwardly to close the gap between the plug and the upper housing 126, and to close the entrance port 298. This closes the inlet flow path 292 and shuts off fluid communication between the chamber 234 and the exterior of the centraliser 200. A further upward movement of the plug 132 now carries the upper housing 126 a further distance upwardly with respect to the tool body 212. This moves the control rod 218 a further distance upwardly past the second seal 286*b*, opening flow through the chamber 234 between the tool flow path 294 and the exhaust flow path 297, whilst shutting off flow into the chamber 234 along the inlet flow path 292, as shown in FIG. 13.

The exhaust chamber 240 is charged with a gas at surface atmospheric pressure or is under a vacuum. Accordingly, the pressure force exerted on the faces 314 of the pistons 244 is now greatly reduced. The force on the piston faces 316 is thus greater, urging the pistons 244 radially inwardly to the retracted position of FIG. 5. The centraliser 200 and tool 10 may then be recovered to surface through the drill string 211. The centraliser 200 may then be re-set and run-in again when required to centralise a tool 10 within the drill string 211. Alternatively, the centraliser 200 may be re-set downhole and thus may be used to perform a number of separate centralising operations before the centraliser 200 is pulled out of the borehole.

In alternative embodiments, other downhole tools may be provided incorporating the control mechanism of the present invention, or the control mechanism may be provided as part of a tool used to control other downhole tools; for example a downhole packer; a downhole valve such as an open/shut valve; a sliding sleeve; a downhole shutting tool (for shutting off a well); or a tool for providing temporary positioning of tools, such as cutting or patching tools, in tubing; or as a trigger for other devices such as sampling tools, perforating tools or any other downhole tool requiring positioning and/or activating.

The fluid activated member may comprise a piston coupled to a sliding sleeve, a valve element such as a ball valve or flapper valve or to any other fluid activated member of a downhole tool.

Various modifications may be made to the foregoing within the scope of the present invention.

It will be understood that the control mechanism essentially acts as a trigger mechanism for activating any fluid activated (hydraulic) downhole tool. The control mechanism has the ability to hold the tool in a desired position or activation state until the control member is moved, allowing fluid to be used as a motive fluid for activation of the downhole tool.

The centraliser may be used for centralising any downhole tool and may be used for centralising a tool within any tubular, such as casing, liner, production tubing or the like. The centraliser may equally be used in an open hole environment and thus may be used for centralising within an open borehole.

The control mechanism may be provided as part of a downhole tool or may be provided separately and coupled to a downhole tool for controlling operation of the tool. Thus the control mechanism may be provided in a separate body or housing coupled to the downhole tool to be controlled.

The control mechanism may be mechanically activated as described above, or may be activated in any other suitable fashion. Accordingly, the control member may be adapted to be moved in response to applied fluid pressure, fluid pressure sequencing or by electronic or electrical control.

The drift tool may include a control mechanism of the type described in relation to the centraliser and vice-verse. It will equally be understood that the flow control mechanism may be used for controlling any type of fluid activated downhole tool and thus of any fluid activated member of a downhole tool.

The centraliser or other downhole tool may include any suitable number of fluid activated members and may thus include any suitable number of pistons. The pistons may be provided at any desired rotational and axial spacing along a length of the centraliser.

The invention claimed is:

1. A flow control mechanism for a downhole tool, the mechanism comprising:

a body defining a fluid chamber;

an inlet flow path for fluid flow into the chamber;

at least one tool flow path for fluid flow between the chamber and at least part of the downhole tool;

an exhaust flow path for fluid flow from the chamber to a fluid exhaust; and control means including a control member mounted for movement within the chamber for controlling flow of fluid into and out of the chamber along the inlet flow path, the at least one tool flow path, and the exhaust flow path, and wherein the fluid is a wellbore fluid, and the control mechanism is activatable in response to applied fluid pressure from the wellbore, wherein the control member is locatable in a first position where flow between the inlet flow path and the chamber, the chamber and the downhole tool and the chamber and the exhaust, respectively, is prevented.

2. A flow control mechanism as claimed in claim 1, wherein the control member is movable to a second position allowing fluid flow between the inlet flow path and the chamber and between the chamber and the downhole tool, and to a third position allowing fluid flow between the downhole tool, the chamber and the exhaust.

3. A flow control mechanism as claimed in claim 1, wherein in the first position, the control member is in sealing engagement with first and second seal elements.

4. A flow control mechanism as claimed in claim 3, wherein in the second position the control member is out of sealing engagement with a first seal for allowing flow into the chamber along the inlet flow path and flow between the chamber and the downhole tool.

5. A flow control mechanism as claimed in claim 4, wherein in the third position the control member is out of sealing engagement with the first seal and a second seal for allowing flow between the downhole tool and the chamber and between the chamber and the exhaust.

6. A flow control mechanism as claimed in claim 5, wherein the inlet flow path is closed before the control member is located in the third position.

7. A flow control mechanism as claimed in claim 5, further comprising an inlet flow path entrance port for supply of fluid into the inlet flow path, the entrance port being closed before the control member is located in the third position.

8. A flow control mechanism as claimed in claim 7, including a movable plug for closing the entrance port.

9. A flow control mechanism for a downhole tool, the mechanism comprising:

a body defining a fluid chamber;

an inlet flow path for fluid flow into the chamber;

at least one tool flow path for fluid flow between the chamber and at least part of the downhole tool;

an exhaust flow path for fluid flow from the chamber to a fluid exhaust; and control means including a control member mounted for movement within the chamber for controlling flow of fluid into and out of the chamber along the inlet flow path, the at least one tool flow path, and the exhaust flow path, and wherein the fluid is a wellbore fluid, and the control mechanism is activatable in response to applied fluid pressure from the wellbore, wherein the fluid exhaust comprises an exhaust chamber isolated from the hydrostatic pressure of fluid outside the mechanism.

10. A flow control mechanism as claimed in claim 9, wherein the exhaust chamber is initially at surface atmospheric pressure.

11. A downhole tool having at least one flow control mechanism, the at least one flow control mechanism comprising:

a body defining a fluid chamber;

an inlet flow path for fluid flow into the chamber;

at least one tool flow path for fluid flow between the chamber and at least part of the downhole tool;

an exhaust flow path for fluid flow from the chamber to a fluid exhaust; and control means including a control member mounted for movement within the chamber for controlling flow of fluid into and out of the chamber along the inlet flow path, the at least one tool flow path, and the exhaust flow path, and wherein the fluid is a wellbore fluid, and the control mechanism is activatable in response to applied fluid pressure from the wellbore, wherein the downhole tool comprises a downhole tool for generating a fluid pressure pulse, further comprising flow restriction means mounted for movement between a first position and a second position where fluid flow is restricted with respect to the first position to generate a fluid pressure pulse, wherein the fluid exhaust comprises an exhaust chamber dimensioned to contain fluid discharged from multiple cycles of movement of the flow restriction means between the first and second positions.

12. A downhole tool comprising:

a housing defining a fluid flow path;

flow restriction means movably mounted in a first chamber in the housing, for movement in response to applied fluid pressure between a first position and a second position where fluid flow is restricted compared to the first position; and activating means including a member movable to cause the flow restriction means to move between the first and second positions, whereby movement of the flow restriction means between the first and second positions displaces fluid from the first chamber into a second, storage chamber defined in the housing.

13. A flow control mechanism for a downhole tool, the downhole tool comprising a downhole tool for generating a fluid pressure pulse, the mechanism comprising:

a body defining a fluid chamber;

an inlet flow path for fluid flow into the fluid chamber;

at least one tool flow path for fluid flow between the fluid chamber and at least part of the downhole tool;

an exhaust flow path for fluid flow from the fluid chamber to a fluid exhaust; and control means including a control member mounted for movement within the fluid chamber for controlling flow of fluid into and out of the fluid chamber along the inlet flow path, the at least one tool flow path, and the exhaust flow path, and wherein the fluid is a wellbore fluid, and the flow control mechanism is activatable in response to applied fluid pressure from the wellbore, and wherein the fluid exhaust comprises a fluid exhaust chamber which is isolated from outside of the mechanism.

* * * * *